United States Patent [19]

Kosfeld

[11] Patent Number: 4,930,406

[45] Date of Patent: Jun. 5, 1990

[54] REFRIGERANT GAS COMPRESSOR CONSTRUCTION

[75] Inventor: Milton M. Kosfeld, Bristol, Tenn.

[73] Assignee: Bristol Compressors, Inc., Bristol, Va.

[21] Appl. No.: 247,405

[22] Filed: Sep. 21, 1988

[51] Int. Cl.[5] ..... F01B 31/08

[52] U.S. Cl. ..... 92/144; 92/169.1; 92/171.1

[58] Field of Search ..... 92/1, 68, 72, 73, 144, 92/169.1, 171.1; 417/571, 529, 564

[56] References Cited

U.S. PATENT DOCUMENTS

| | | | |
|---|---|---|---|
| 2,565,564 | 9/1951 | Lamberton | 417/571 |
| 2,956,738 | 10/1960 | Rosenschold et al. | 92/144 |
| 3,986,798 | 10/1976 | Lindell et al. | 417/564 |
| 4,035,110 | 7/1977 | Plasko, Jr. | 92/144 |
| 4,052,972 | 10/1977 | Mizunuma et al. | 92/144 |

FOREIGN PATENT DOCUMENTS

| | | | |
|---|---|---|---|
| 888625 | 12/1943 | France | 417/571 |
| 1330486 | 5/1963 | France | 417/571 |
| 2018364 | 10/1979 | United Kingdom | 92/144 |
| 2071269 | 9/1981 | United Kingdom | 92/144 |

*Primary Examiner*—Robert E. Garrett
*Assistant Examiner*—Thomas Denion

[57] ABSTRACT

A refrigerant compressor construction including one or more cylinders and pistons and a cylinder head mounted over the end of the cylinders, the head having a base, a first wall providing a suction chamber and a second wall providing a discharge chamber, each of the walls being unitary with the base and spaced from each other to provide a thermal barrier between the chambers to minimize suction gas heating.

5 Claims, 2 Drawing Sheets

REFRIGERANT GAS COMPRESSOR CONSTRUCTION

This invention concerns a gas compressor of the type employed for refrigeration or air-conditioning systems, wherein the compressor is electrically powered and hermetically sealed, and particularly concerns novel compressor head structure which enhances suction gas density and affords substantial improvements in compressor operating characteristics including capacity and efficiency.

Such compressors as employed, for example, in closed loop, hermetically sealed central air conditioning units and window unit air conditioners, are required to provide highly compressed refrigerant gas in a thermodynamically efficient manner which becomes increasingly difficult as load requirements increase the temperature of the compression system and effect a diminution in density of the suction gas fed to and contained in the compression chamber. This is especially a problem with those types of compressors which employ a common compressor head for handling the gas flow for both the compressed gas or discharge side, and the low pressure gas or suction side of the unit. The head, typically of cast metal, is conveniently manufactured to provide side-by-side or adjacent suction and discharge chambers separated by a dividing wall as shown, for example, in U.S. Pat. Nos. 3,306,524; 3,998,571; 3,412,931; and 3,509,907. This type of head construction actually tends to equilibrate the suction gas temperature by means of the dividing wall which provides an excellent heat transfer medium between the chambers. Thus the suction gas becomes too hot to have sufficient density to maintain high compressor efficiency. Other patents which show such head construction and actually take steps, through means other than the present invention, to solve the suction gas heating problem are U.S. Pat. Nos.: 4,573,881; 4,371,319; 3,584,981; and 4,531,894.

The present invention has as principal objects therefore, to provide a refrigerant gas compressor, the head of which contains both suction side and discharge side porting but which is so constructed as to maintain a higher suction gas density than has heretofore been possible in similar type equipment, and to thereby improve the overall operating capacity and efficiency of the compressor in a reliable and low cost manner.

These and other objects hereinafter becoming evident have been attained in accordance with the present invention which is defined in the context of a compressor assembly as a refrigerant compressor having cylinder means, piston means mounted for reciprocation in said cylinder means, and cylinder head means mounted over the end of said cylinder means and comprising base means, first wall means providing suction chamber means and second wall means providing discharge chamber means, each said wall means being unitary with said base means and spaced from each other to provide thermal barrier means between the chamber means.

In certain preferred embodiments: the head is elongated to accommodate dual pistons, and the suction and discharge chambers are side-by-side and elongated with their exterior adjacent side walls separated to provide the thermal barrier; and the ratio of the volume ($in^3$) of the thermal barrier to the combined surface area ($in^2$) of contiguous side walls is from about 0.003 to about 0.3, more preferably from about 0.006 to about 0.15, and most preferably from about 0.015 to about 0.06.

Other preferred embodiments and operation of the invention are hereinafter described and shown in the drawings wherein.

Figure 1:
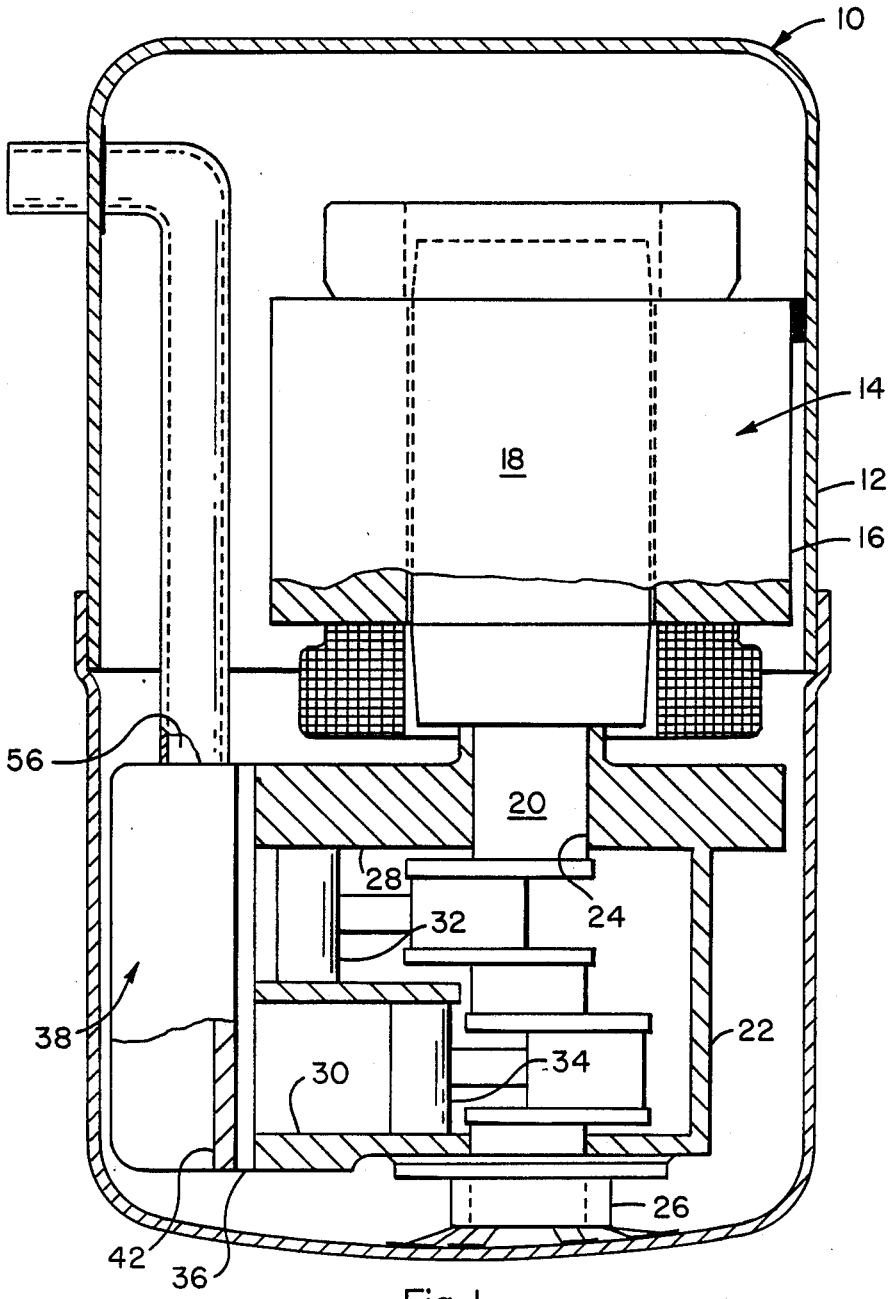
FIG. 1 is a longitudinal cross-sectional view of a typical compressor unit in which the present head shown partially in cross-section can be employed.
Figure 2:
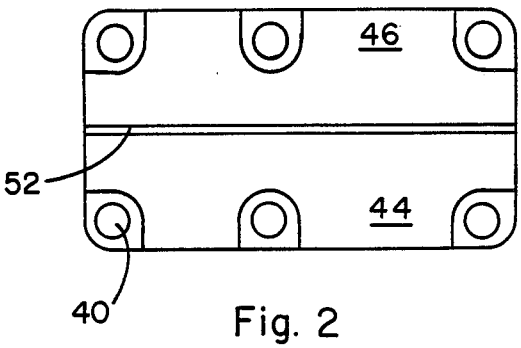
FIG. 2 is a top elevational view of the present compressor head.
Figure 3:
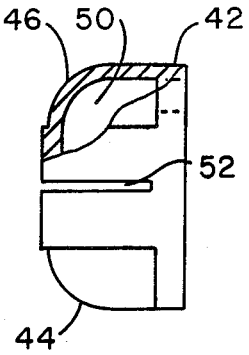
FIG. 3 is and end elevational view of the head.
Figure 4:
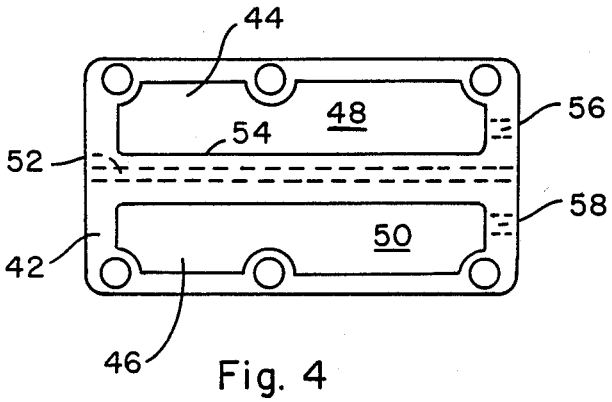
FIG. 4 is a bottom or base elevational view of the head.

Referring to the drawings, a hermetic type refrigeration compressor 10 comprises a shell 12 in which is mounted an electric motor generally designated 14 having a stator 16 and rotor 18. The rotor is connected to the crankshaft 20 of the compressor which comprises a casing 22 provided with suitable bearings 24 and 26 for rotatably supporting the crankshaft. The casing is formed with cylinders 28 and 30 in which pistons 32 and 34 respectively are mounted for reciprocation in conventional manner. A valve or gas porting plate 36 covers the ends of the cylinders and typically supports the reed or other such intake and exhaust valving such as is shown, for example, in U.S. Pat. Nos.: 3,509,907; 3,584,981; 4,330,999; and 4,353,682; the valving structure disclosures of which are incorporated herein by reference.

The compressor head of the present invention in the exemplary embodiment of the drawings is generally designated 38 and mounted over the value plate and secured to the compressor casing 22 by suitable bolts 40 in conventional manner. The head is comprised of a base 42 which is unitary with two dome-like walls 44 and 46 which are formed respectively to provide inlet or suction chamber 48 and discharge chamber 50. These walls are separated by a space or slot 52 formed during casting of the head or machined therein. The configuration of the slot may be widely varied, e.g., it may be substantially tapered outwardly from bottom to top to provide adequate casting draft. The slot also is of a suitable dimension, depending on the operating characteristics of the compressor, particularly its running discharge temperature profile, to provide a thermal barrier which significantly reduces the heat transfer from the discharge side of the head to the suction side. It has been found that the ratios given above of the volume ($in^3$) of the thermal barrier or slot to the combined surface area ($in^2$) of the contiguous side walls of 44 and 46 gives marked reductions in heat transfer to the suction side. For example, for a typical discharge gas temperature of about 250° F. and a typical suction gas temperature of about 145° F., the thermal barrier gives about a 10° F. reduction in suction gas temperature which effects about a 2% or greater efficiency in the compressor operation.

As indicated above, the slot 52 can be varied in its cross-sectional configuration, e.g., it may be substantially V shaped or the like, and also may be longitudinally irregular. Such variations may be employed to accommodate certain desired sizes and configurations of the head domes or the dividing segment 54 into which the slot is machined or cast. The volume of the thermal barrier for the above ratio can be mathematically determined in known manner for any configuration of the slot. The depth of the slot will always be the distance from a straight edge laid across the top of the slot to the point directly beneath at the bottom of the slot. The points of entry for the suction gas and of exit for the discharge gas may also be varied as is known to the art, and in the exemplary embodiment shown are respectively at 56 and 58.

The present invention has application as indicated above, to single cylinder as well as multi-cylinder compressors, and to head structure employing multiple, e.g., four or more domes which could be provided with individual suction and discharge porting systems. For such structure, the aforesaid ratio is still applicable.

This invention has been described in detail with particular reference to preferred embodiments thereof, but it will be understood that variations and modifications will be effected within the spirit and scope of the invention.

I claim:

1. A refrigerant compressor having cylinder means, piston means mounted for reciprocation in said cylinder means, and a unitary, elongated, cylinder head mounted over the end of said cylinder means and comprising a base, a first wall providing an elongated suction chamber and a second wall providing an elongated discharge chamber, each of said walls being unitary with said base, said suction and discharge chambers being side-by-side and elongated with their exterior adjacent side walls separated the full length of said head to provide a thermal barrier, wherein the ratio of the volume ($in^3$) of the thermal barrier to the combined surface area ($in^2$) of contiguous side walls is from 0.003 to 0.3.

2. The compressor of claim 1 wherein the ratio is from 0.006 to 0.15.

3. The compressor of claim 1 wherein the ratio is from 0.015 to 0.06.

4. The compressor of claim 1 wherein the thermal barrier comprises a slot either cast or machined in the head in a section thereof lying substantially intermediate said suction and discharge chambers.

5. The compressor of claim 4 wherein said slot is tapered outwardly from bottom to top.

* * * * *